US006966725B2

(12) United States Patent
Cochran

(10) Patent No.: US 6,966,725 B2
(45) Date of Patent: Nov. 22, 2005

(54) APPARATUS FOR SPREADING AGGREGATE MATERIAL ON A ROAD BERM

(76) Inventor: Norman L. Cochran, 10286 Rubins Rd., Kenton, OH (US) 43326

( * ) Notice: Subject to any disclaimer, the term of this patent is extended or adjusted under 35 U.S.C. 154(b) by 0 days.

(21) Appl. No.: 10/720,334

(22) Filed: Nov. 25, 2003

(65) Prior Publication Data

US 2005/0084331 A1 Apr. 21, 2005

Related U.S. Application Data

(60) Provisional application No. 60/512,775, filed on Oct. 21, 2003.

(51) Int. Cl.[7] ..... E01C 19/00
(52) U.S. Cl. ..... 404/85; 404/101; 180/199
(58) Field of Search ..... 404/101, 104, 404/108, 109, 110, 85; 171/16; 111/925; 180/199, 200, 202

(56) References Cited

U.S. PATENT DOCUMENTS

| | | | | | |
|---|---|---|---|---|---|
| 1,040,888 | A | | 10/1912 | Comrie | |
| 1,473,369 | A | * | 11/1923 | Williams et al. | 180/200 |
| 1,639,054 | A | * | 8/1927 | Palmer | 180/200 |
| 2,101,150 | A | * | 12/1937 | Moore, Jr. | 404/85 |
| 2,134,883 | A | * | 11/1938 | Moore, Jr. | 404/85 |
| 2,171,466 | A | * | 8/1939 | Yanocsik | 180/200 |
| 2,348,445 | A | * | 5/1944 | Bayer | 404/85 |
| 2,608,143 | A | * | 8/1952 | Haupt | 404/85 |
| 2,645,986 | A | | 7/1953 | Rasmussen | |
| 2,647,448 | A | | 8/1953 | Osterfeld | |
| 2,752,832 | A | | 7/1956 | Fink | |
| 2,803,307 | A | * | 8/1957 | Ferrer | 180/202 |
| 2,954,241 | A | | 9/1960 | Warren | |
| 2,962,946 | A | | 12/1960 | Neff | |
| 2,962,947 | A | | 12/1960 | MacDonald | |
| 2,985,080 | A | * | 5/1961 | Harrison et al. | 404/85 |
| 3,000,277 | A | | 9/1961 | Crane et al. | |
| 3,002,577 | A | * | 10/1961 | Williams | 180/200 |
| 3,058,404 | A | | 10/1962 | Widelo | |
| 3,091,999 | A | | 6/1963 | MacDonald | |
| 3,304,101 | A | | 2/1967 | Layton | |
| 3,396,643 | A | * | 8/1968 | Johnson | 404/85 |
| 3,577,897 | A | | 5/1971 | Bodine | |
| 3,623,562 | A | * | 11/1971 | Pitra | 180/200 |
| 3,743,432 | A | * | 7/1973 | Lee | 404/84.1 |
| 3,907,451 | A | * | 9/1975 | Fisher et al. | 404/101 |

(Continued)

*Primary Examiner*—Gary S. Hartmann
(74) *Attorney, Agent, or Firm*—Manelli Denison & Selter; Edward J. Stemberger

(57) ABSTRACT

An apparatus is provided for spreading aggregate material on ground. The apparatus includes a body 12, an engine 14 carried by the body, motive structure 18 powered by the engine to move the apparatus along the ground. A hopper 20 is associated with the body and is constructed and arranged to receive aggregate material from a source of aggregate material. Dispensing structure 24, associated with the hopper, is constructed and arranged to dispense aggregate material from the hopper to the ground. Wheel structure 30, carried by the body, is constructed and arranged to be movable between an inoperative position, wherein the motive structure is in a ground engaging position and the wheel structure is in a position so as not to engage the ground, and an operative position, wherein the wheel structure is in a ground engaging position and the motive structure is in a position so as not to engage the ground. A hitch structure 32, carried by the body, is constructed and arranged to be coupled to a vehicle so that the apparatus can be towed by the vehicle when the wheel structure is in the operative position thereof.

19 Claims, 4 Drawing Sheets

U.S. PATENT DOCUMENTS 3,990,721 A 11/1976 Hoffman
4,188,152 A 2/1980 Kitt
4,244,662 A 1/1981 Olson
4,253,256 A * 3/1981 Feliz ..... 37/104
4,390,304 A 6/1983 Jacobson, Jr. et al.
4,568,219 A 2/1986 Berry
4,605,086 A * 8/1986 Marom ..... 180/202
4,655,635 A 4/1987 Furukawa
4,678,365 A 7/1987 Ban et al.
4,700,786 A 10/1987 Berry
4,834,206 A * 5/1989 Ching-Tang ..... 180/202
4,871,025 A 10/1989 Mayfield et al.
4,895,476 A * 1/1990 Vangaever ..... 404/108
4,955,754 A * 9/1990 Smith ..... 404/108
4,998,595 A * 3/1991 Yeh ..... 180/202
5,470,175 A * 11/1995 Jensen et al. ..... 404/72
5,868,600 A * 2/1999 Watanabe ..... 446/460
6,467,992 B1 * 10/2002 Dietrich ..... 404/101
6,481,925 B1 11/2002 Olson

* cited by examiner

APPARATUS FOR SPREADING AGGREGATE MATERIAL ON A ROAD BERM

This application is based on U.S. Provisional Application No. 60/512,775, filed on Oct. 21, 2003 and claims the benefit thereof for priority purposes.

FIELD OF THE INVENTION

The invention relates to an apparatus for spreading aggregate material such as stone on a berm or road shoulder, more particularly, to an apparatus that can spread the aggregate material and then be towed behind a vehicle to another location.

BACKGROUND OF THE INVENTION

In road maintenance and road building, there is a need to spread aggregate material such as stone precisely along the shoulder or berm of the road. Typical aggregate spreaders include a hopper that receives the aggregate material from a dump truck. The spreader pushes the truck forwardly while spreading the aggregate material. Once the job is finished, the conventional spreader is typically loaded on a semi low-boy trailer to be transported to the next job, which requires the trailer, is costly, and is time consuming.

Accordingly, there is a need to provide an aggregate spreading apparatus that can spread aggregate at one job site under its own power while pushing a supply truck and then be towed behind a vehicle to another job site.

SUMMARY OF THE INVENTION

An object of the present invention is to fulfill the need referred to above. In accordance with the principles of the present invention, this objective is obtained an apparatus for spreading aggregate material on ground. The apparatus includes a body, an engine carried by the body, motive structure powered by the engine to move the apparatus along the ground. A hopper is associated with the body and is constructed and arranged to receive aggregate material from a source of aggregate material. Dispensing structure, associated with the hopper, is constructed and arranged to dispense aggregate material from the hopper to the ground. Wheel structure, carried by the body, is constructed and arranged to be movable between an inoperative position, wherein the motive structure is in a ground engaging position and the wheel structure is in a position so as not to engage the ground, and an operative position, wherein the wheel structure is in a ground engaging position and the motive structure is in a position so as not to engage the ground. A hitch structure, carried by the body, is constructed and arranged to be coupled to a vehicle so that the apparatus can be towed by the vehicle when the wheel structure is in the operative position thereof.

BRIEF DESCRIPTION OF THE DRAWINGS

The invention will be better understood from the following detailed description of the preferred embodiments thereof, taken in conjunction with the accompanying drawings, wherein like reference numerals refer to like parts, in which.

DETAILED DESCRIPTION OF THE EXEMPLARY EMBODIMENT

Figure 3:
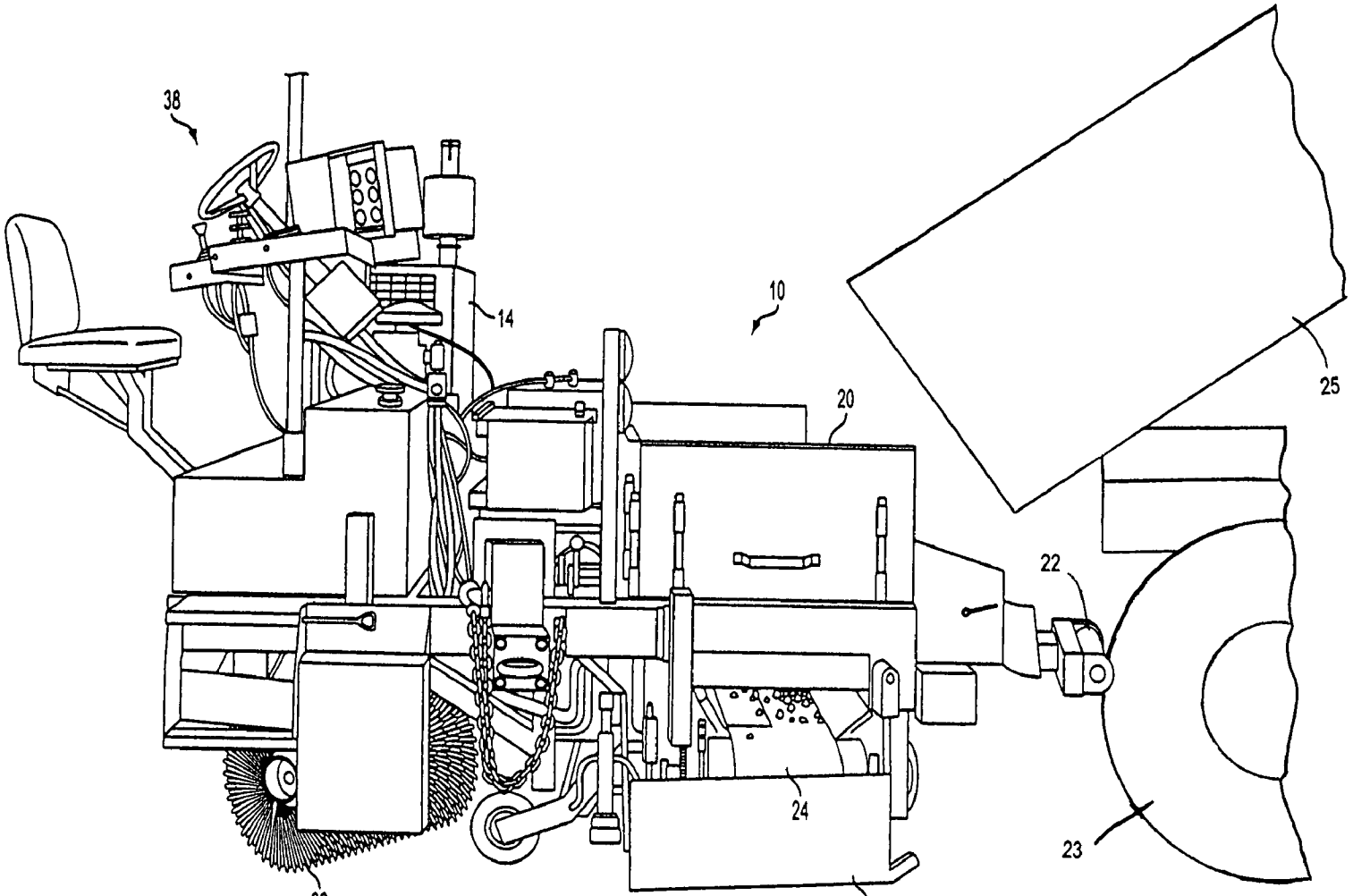
FIG. 3 is a right side view of the device of FIG. 2.

An apparatus for spreading aggregate material, generally indicated at 10, is shown in FIGS. 1–4 in accordance with the principles of the invention. The apparatus includes a body 12 with an engine 14 carried by the body 12. The engine is preferably a diesel or gasoline fueled engine. A hydraulic system 16 is provided for supplying power from the engine 14 to the apparatus. The hydraulic system 16 includes the conventional hydraulic motors (not visible) and tubing to hydraulically operate equipment on the apparatus 10. Motive structure, generally indicated at 17, is powered and controlled in the conventional manner by the hydraulic system 16 to move the apparatus 10 along the ground in an advancing direction B (FIG. 3). In the embodiment, the motive structure 17 is in the form of a pair of steerable driving tracks 18 disposed in spaced relation with respect to the body 12. It can be appreciated that the motive structure 17 can be driving wheels or other structure for supporting and moving the apparatus 10 along the ground.

Figure 1:
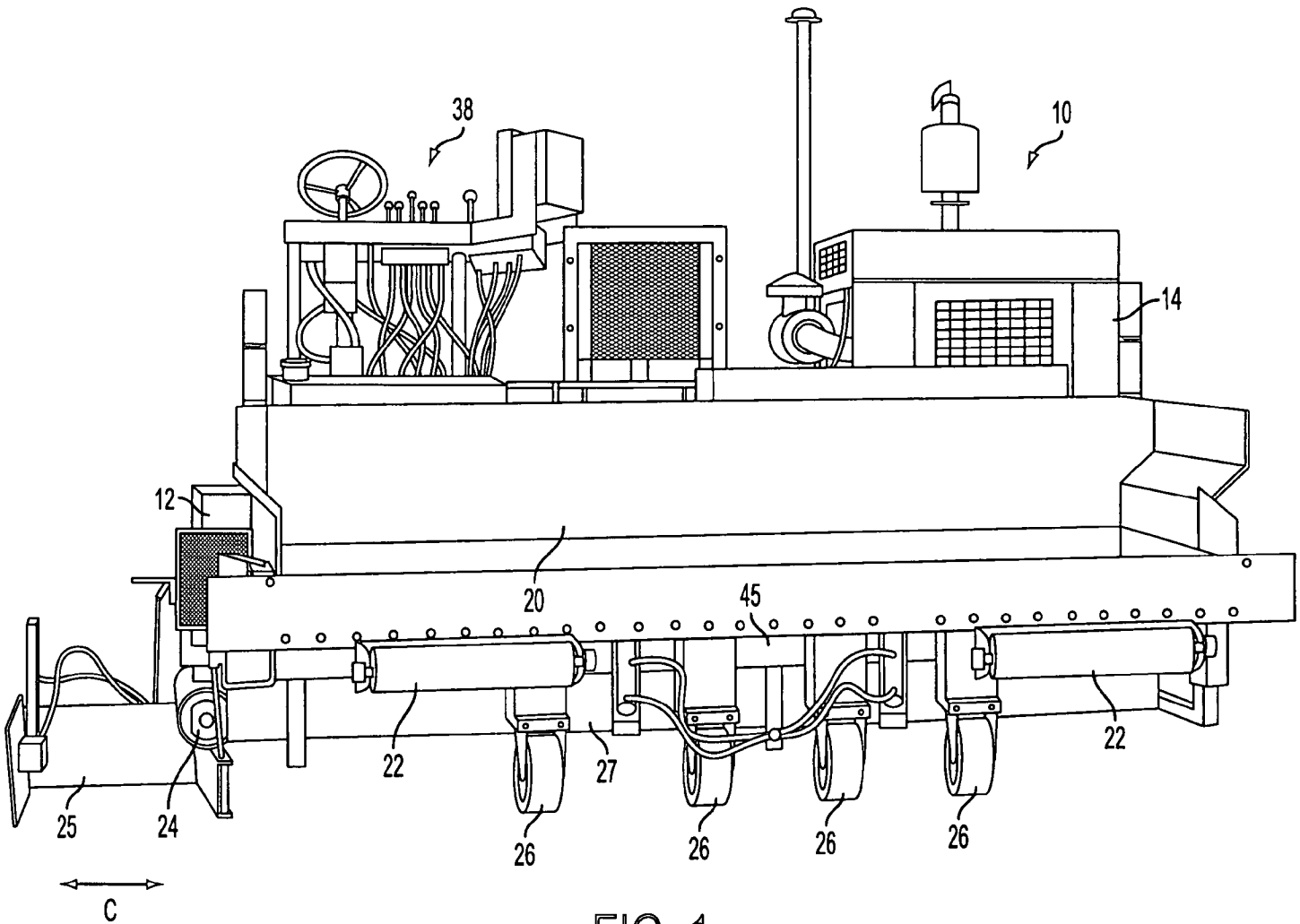
FIG. 1 is a front view of an aggregate spreading apparatus provided in accordance with the principles of the present invention.
Figure 2:
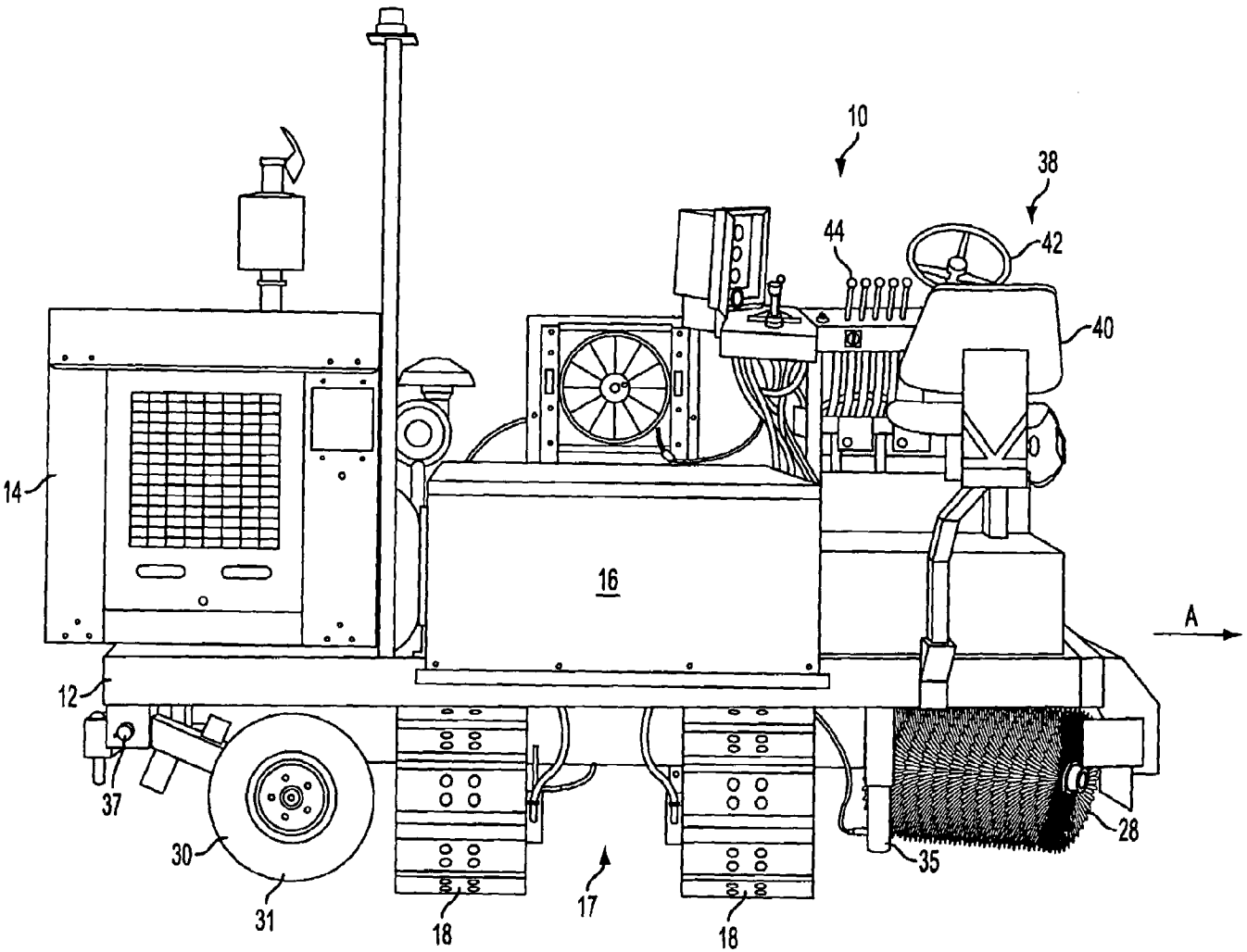
FIG. 2 is a rear view of the apparatus of FIG. 1.

As best shown in FIG. 1, a hopper 20 is associated with the body 12. The hopper 20 is constructed and arranged to receive aggregate material such as stone from a source of aggregate material, for example, a dump truck. At the front of the body near the hopper, push rollers 22 are provided and are used in engaging the tires 23 of a dump truck 25 (FIG. 3) as the apparatus 10 pushes the dump truck forwardly while spreading the stone. The push rollers 22 are preferably hydraulically adjustable towards and away from the body 12. Rolling and swiveling casters 26 are provided, preferably on a center-pivoting walking beam 45, so as to pivot therewith to maintain contact with the road while the apparatus 10 spreads stone.

Dispensing structure 24 is associated with the hopper 20 and is constructed and arranged to dispense aggregate material from the hopper 20 to the ground. In the embodiment, the dispensing structure 24 is in the form of a conveyor that receives the aggregate material from the hopper and dispenses the material to the ground (e.g., berm). The conveyor 24 is controlled by the hydraulic system 16 and is arranged to dispense aggregate material in a direction transverse with respect to the advancing direction B. A stone box or guide 25 is associated with the dispensing end of the conveyor 24 to aid in controlled dispensing of the aggregate material. In particular, stone falling from the end of the conveyor 24 is directed toward the stone box 26 that limits the extent (width) to which the stone is dispensed along the road. The stone box 26 is adjustable in the directions of arrow C (FIG. 1) to control the width of stone dispensed. The conveyor 24 can be shut-off if too much stone is delivered and can be restarted when the proper amount of stone is present. A powered roller broom 28 is provided on the body 12 for sweeping the dispensed stone from unwanted areas.

Figure 4:
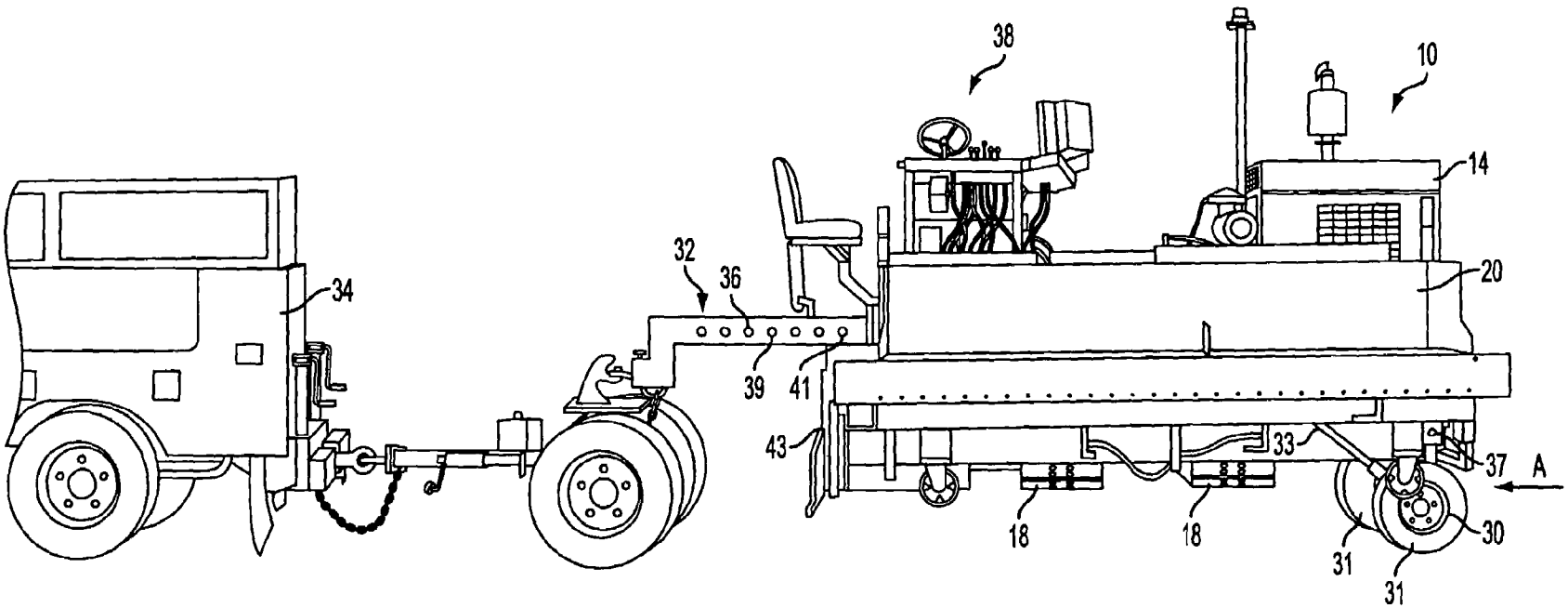
FIG. 4 is a left side view of the device of FIG. 2.

Wheel structure 30 is carried by the body 12 so as to enable the apparatus 10 to move in a towing direction A. The wheel structure 30 is constructed and arranged to be movable between an inoperative position, wherein the motive structure 17 is in a ground engaging position and the wheel structure 30 is in a position so as not to engage the ground (FIG. 2), and an operative position, wherein the wheel structure 30 is in a ground engaging position and the motive structure 17 is in a position so as not to engage the ground (FIG. 4). At least one hydraulic actuator 33 is operatively associated with the wheel structure 30 and is controlled by the hydraulic system 16 to move the wheel structure 30 about pivot 37 between the operative and inoperative positions. The wheel structure 30 includes at least a pair of wheels 31 disposed in spaced relation. In the embodiment, four wheels 31 are provided. As can be appreciated from FIGS. 3 and 4, the tracks 18 and wheels 31 are arranged such that the advancing direction B is transverse with respect to the towing direction A.

The body 12 carries a hitch structure, generally indicated at 32. The hitch structure 32 is constructed and arranged to be coupled to a vehicle 34 so that the apparatus 10 can be towed when the wheel structure 30 is in the operative position thereof (FIG. 4). In the embodiment, an arm 36 of the hitch structure 32 can be extended and retracted with respect to the body 12. The arm 36 includes a plurality of openings 39 therein for receiving a pin 41 to adjust the length of extension of the arm 36 with respect to the body 12. When the hitch structure 32 is not in use, the arm 36 can be stowed within a portion of the body 12. The arm 36 can be manually movable or moved mechanically by a hydraulic actuator or the like.

At least one lift jack 35 is provided and is hydraulically actuated to an extended position to lift the hitch end 43 of the body 12 with respect to the ground to be in a position to enable the hitch structure 32 to be attached to a towing vehicle.

Providing two lift jacks 35 is preferable to maintain balance of the apparatus 10 while being lifted. Once the hitch structure 32 is coupled with the vehicle, the actuator 33 is actuated to move the wheel structure 30 to the operative, ground engaging position and the lift jack(s) are retracted.

An operator's station, generally indicated at 38, is provided on the body 12. The operator's station 38 includes a seat 40, a steering wheel 42, and hydraulic controls 44 that are associated with the hydraulic system 16 for controlling the hydraulic equipment on the apparatus 10.

In spreading the aggregate material, the apparatus 10 is self-powered and is advanced by the motive structure 17. The apparatus 10 pushes the supply truck that fills the hopper 20, while dispensing the aggregate material. When the hitch structure 32 is extended and coupled to a vehicle and the wheel structure 30 is moved to the operative position, the apparatus 10 can be easily towed behind the vehicle to a new location. Thus, there is no need to provide a low-boy trailer to carry and move the apparatus 10 to another location.

The foregoing preferred embodiments have been shown and described for the purposes of illustrating the structural and functional principles of the present invention, as well as illustrating the methods of employing the preferred embodiments and are subject to change without departing from such principles. Therefore, this invention includes all modifications encompassed within the spirit of the following claims.

What is claimed is:

1. An apparatus for spreading aggregate material on ground, the apparatus comprising:

a body, an engine carried by the body, motive structure powered by the engine to move the apparatus along the ground, a hopper, associated with the body, constructed and arranged to receive aggregate material from a source of aggregate material, dispensing structure, associated with the hopper, constructed and arranged to dispense aggregate material from the hopper to the ground, non-driving wheel structure, carried by the body, constructed and arranged to be movable between an inoperative position, wherein the motive structure is in a ground engaging position and the wheel structure is in a position so as not to engage the ground, and an operative position, wherein the wheel structure is in a ground engaging position and the motive structure is in a position so as not to engage the ground, a hitch structure, carried by the body, constructed and arranged to be coupled to a vehicle so that the apparatus can be towed by the vehicle when the wheel structure is in the operative position thereof, and at least one lift jack constructed and arranged to engage the ground and lift a portion of the body with respect to the ground to enable the hitch structure to be in a position to be coupled with a vehicle for towing of the apparatus, wherein the source of aggregate material is a dump truck and the apparatus includes push rollers mounted with respect to the body and constructed and arranged to engage tires of the dump truck so that the apparatus pushes the dump truck while dispensing aggregate material, the push rollers being constructed and arranged to be adjustable towards and away from the body.

2. The apparatus of claim 1, further including a hydraulic system constructed and arranged to supply power from the engine to the motive structure.

3. The apparatus of claim 1, wherein the motive structure includes a pair of steerable tracks disposed in spaced relation with respect to the body and arranged to move the apparatus in an advancing direction.

4. The apparatus of claim 3, wherein the dispensing structure is a conveyor arranged to dispense aggregate material in a direction transverse with respect to the advancing direction.

5. The apparatus of claim 3, wherein the wheel structure includes at least a pair of wheels that enables the apparatus to move in a towing direction.

6. The apparatus of claim 5, wherein the tracks and wheels are arranged such that the advancing direction is transverse with respect to the towing direction.

7. The apparatus of claim 1, wherein the hitch structure includes an arm, the arm being adjustably retractable with respect to the body.

8. The apparatus of claim 1, further comprising a powered broom structure, carried by the body, constructed and arranged to sweep aggregate material on the ground.

9. The apparatus of claim 2, further comprising a hydraulic actuator operatively associated with the wheel structure and controlled by the hydraulic system to move the wheel structure between the operative and inoperative positions.

10. The apparatus of claim 1, further comprising an adjustable guide associated with the dispensing structure for controlling dispensing of the aggregate material.

11. An apparatus for spreading aggregate material on ground, the apparatus comprising:

a body, an engine carried by the body, means, powered by the engine, for moving the apparatus along the ground, a hopper, associated with the body, constructed and arranged to receive aggregate material from a source of aggregate material, means, associated with the hopper, for dispensing aggregate material from the hopper to the ground, non-driving means, carried by the body, for supporting the body for towing, the means for supporting being constructed and arranged to be movable between an inoperative position, wherein the means for moving is in a ground engaging position and the means for supporting is in a position so as not to engage the ground, and an operative position, wherein the means for supporting is in a ground engaging position and the means for moving is in a position so as not to engage the ground, a hitch structure, carried by the body, constructed and arranged to be coupled to a vehicle so that the apparatus can be towed by the vehicle when the means for supporting is in the operative position thereof, and at least one lift jack constructed and arranged to engage the ground and lift a portion of the body with respect to the ground to enable the hitch structure to be in a position to be coupled with a vehicle for towing the apparatus.

wherein the source of aggregate material is a dump truck and the apparatus includes push rollers mounted with respect to the body and constructed and arranged to engage tires of the dump truck so that the apparatus pushes the dump truck while dispensing aggregate material, the push rollers being constructed and arranged to be adjustable towards and away from the body.

12. The apparatus of claim 11, further including a hydraulic system for supplying power from the engine to the means for moving.

13. The apparatus of claim 12, wherein the means for moving includes a pair of steerable tracks disposed in spaced relation with respect to the body and arranged to move the apparatus in an advancing direction, the tracks being powered by the hydraulic system.

14. The apparatus of claim 13, wherein the means for dispensing is arranged to dispense aggregate material in a direction transverse with respect to the advancing direction.

15. The apparatus of claim 13, wherein the means for supporting includes at least a pair of wheels that enables the apparatus to move in a towing direction.

16. The apparatus of claim 15, wherein the tracks and wheels are arranged such that the advancing direction is transverse with respect to the towing direction.

17. The apparatus of claim 11, wherein the hitch structure includes an arm, the arm being adjustably retractable with respect to the body.

18. The apparatus of claim 11, further comprising a powered broom structure, carried by the body, constructed and arranged to sweep aggregate material on the ground.

19. The apparatus of claim 12, further comprising a hydraulic actuator operatively associated with the means for supporting and controlled by the hydraulic system to move the means for supporting between the operative and inoperative positions.

* * * * *